United States Patent [19]

Contant et al.

[11] Patent Number: 4,778,397

[45] Date of Patent: Oct. 18, 1988

[54] TRACK LIGHTING SYSTEM AND CONNECTING PLUG WITH SLIDING LOCK

[75] Inventors: Cornelis J. Contant; Christianus G. Cuijpers, both of Oss, Netherlands

[73] Assignee: U.S. Philips Corp., New York, N.Y.

[21] Appl. No.: 903,852

[22] Filed: Aug. 29, 1986

Related U.S. Application Data

[63] Continuation of Ser. No. 717,631, Mar. 29, 1984, abandoned.

[30] Foreign Application Priority Data

Apr. 2, 1984 [NL] Netherlands ..... 8401029

[51] Int. Cl.[4] ..... H01R 13/60

[52] U.S. Cl. ..... 439/116; 439/261

[58] Field of Search ..... 339/20, 21, 22 R, 22 B, 339/21 S, 22 T, 23; 439/259, 261

[56] References Cited

U.S. PATENT DOCUMENTS

| | | | |
|---|---|---|---|
| 2,924,802 | 2/1960 | Platz et al. | 339/21 R |
| 3,792,413 | 2/1974 | Hyrlainen | 339/21 R |
| 3,813,633 | 5/1974 | Clement | 339/21 R |
| 3,832,503 | 8/1974 | Crane | 339/21 R |
| 3,871,729 | 3/1975 | Attema | 339/21 R |
| 4,032,208 | 6/1977 | Berkenhoff | 339/21 R |
| 4,473,869 | 9/1984 | De Widt | 362/226 |
| 4,508,400 | 4/1985 | Herbert | 339/22 R |

FOREIGN PATENT DOCUMENTS

| | | | |
|---|---|---|---|
| 0856957 | 11/1970 | Canada | 339/22 B |

*Primary Examiner*—Joseph H. McGlynn

*Attorney, Agent, or Firm*—Brian J. Wieghaus

[57] ABSTRACT

A current collector device intended to be connected to a voltage rail comprising a bottom part (1) with two parallel side walls (2, 3) on whose inner side longitudinally extending ribs (4, 5, 6, 7) are provided, while at least two mutually insulated current conductors (11, 9, 10) are present on the bottom part, this current collector device comprising a housing of synthetic material which is provided with projecting contact members (14, 15) and is shaped so that it can be pressed into the rail, an electrical connection being established between the contact members and the current conductors, while the housing is detachably secured to the side walls of the voltage rail by means of edges (20, 21) cooperating with the ribs (4 and 5) in the rail, the housing accommodating a carriage (13) which carries the contact members and is slidable between a decoupling position, in which the housing can be pressed into the rail, and a coupling position, in which the housing is locked in the rail in the pressed-in state.

16 Claims, 3 Drawing Sheets

TRACK LIGHTING SYSTEM AND CONNECTING PLUG WITH SLIDING LOCK

This is a continuation of application Ser. No. 717,631, filed Mar. 29, 1984, now abandoned.

The invention relates to a current collector device such as a connector plug intended to be connected to a voltage rail of the kind used in track lighting; and more particularly, such a plug used with a rail unit having a bottom part, two parallel side walls with longitudinally extending ribs on their inner sides, and at least two mutually insulated current conductors mounted on the bottom part. The plug or current collector device comprises a housing of synthetic material having projecting contact members, shaped so that it can be pressed into the rail, an electrical connection being formed between the contact members and the current conductors. This housing is detachably secured to the side walls of the voltage rail by engagement between parts of the housing and the ribs in the rail. Such a current collector device is known from Netherlands Patent Application No. 7113699 laid open to public inspection, to which U.S. Pat. No. 3,871,729 corresponds.

The known current collector device comprises a detachable housing to be clamped in a wiring channel for forming a connection between, for example, a cable secured to the housing and electrical conductors disposed in the cable channel. The wiring channel is in the form of a rail having a bottom part with mutually insulated current conductors and two parallel profiled side walls on either side thereof.

In this device, upon coupling to the rail, the electrical connection between the contact members secured to the housing and the current conductors is established by a pressure contact. Especially if the current conductors are contaminated or if a thin oxide film is present on the conductors (which often consist of copper), there is a high risk of the occurrence of a poor electrical contact. This is disadvantageous. For securing the housing of synthetic material on the rail, the side wall of the housing is provided with locking cams cooperating with ribs in the rail. The locking effect is achieved by pressing the side wall of the housing inwards during insertion. In order to improve the resilient properties of this plug housing wall portion, a number of wedge-shaped recesses are provided in the side wall. Not only are stringent requirements imposed on the synthetic material, but a mechanically comparatively weak area is also formed in the housing. Moreover, there is a risk that the carrying capacity of the housing is insufficient in the fixture weight locked condition, especially for coupling comparatively heavy luminaires light fixtures.

SUMMARY OF THE INVENTION

The object of the invention is to provide a current collector device whose housing is constructed so that the aforementioned disadvantages, which are inherent in the known device, are avoided.

According to the invention, a current collector device or plug of the general kind described above has a housing which accommodates a carriage which carries the contact members and which is slidable between a decoupled position, in which the housing can be pressed into the rail, and a coupled position, in which the housing is locked in the rail in the pressed-in state.

The housing of the device according to the invention comprises only a small number of components, is of rigid construction, can be assembled in a comparatively simple manner and can be readily manipulated by a user. The housing can be readily pressed into the space of the rail enclosed by the side walls and the bottom part of the rail, the carriage then occupying the decoupled position. When the housing is placed on and pressed into the rail, the contact members form a pressure connection (preferably with a certain amount of resilient force) with the current conductors, which are located on the bottom part of the rail. Subsequently, the housing is mechanically locked in its position on the rail, after which the carriage need be moved only in the longitudinal direction of the rail by the user until the carriage reaches its coupled position. When the carriage is moved in the longitudinal direction, the contact members secured to the carriage, which may be blade shaped, slide over the surfaces of the respective current conductors ensuring a good electrical contact between the said members and the current conductors.

The locking on the voltage rail is preferably obtained in that the housing is provided with resilient tongues which are located on either side of the carriage and cooperate on the one hand with the ribs on the inner side of the side walls of the rail and on the other hand with cams on the carriage.

During locking, when the carriage is adjusted to the coupled position, the resilient tongues are pressed slightly outwards by the cams and are then locked behind the ribs present in the side walls of the rail. A reliable locking is then obtained.

In a particular embodiment of the device according to the invention, the housing is provided with upright walls which are located on either side of the carriage and cooperate on their inner side with the carriage and on their outer side with the side walls of the rail when the housing is placed on the rail.

This embodiment has the advantage that not only correct positioning of the carriage with respect to the housing is obtained, but that due to the upright walls a good guidance is also obtained when the housing is placed on and pressed into the rail.

The current collector device according to the invention is connected in a practical embodiment to a luminaire. This connection is preferably detachable. Such a detachable connection between a housing of synthetic material and a luminaire is described, for example, in Netherlands Patent Application No. 8104430, to which U.S. Pat. No. 4,473,869 corresponds. The construction described in this patent can advantageously be used in the device according to the invention. The housing of the device is provided for this purpose on its side remote from the carriage with a collar, which encloses a cylindrical cavity. In a preferred embodiment, the cavity receives a tubular wall portion of a luminaire having a contact pin and a metal cylindrical contact coaxial with the pin. A second set of contacts on the carriage for mating with the luminaire contacts are in the form of contacts arranged on the lower side of two coaxially arranged sleeves of electrically insulating material. The contacts on the lower sides of the sleeves are connected to the respective contact members which engage the track current supply conductors. These sleeves are described in U.S. Pat. No. 4,413,869. A preferred embodiment of the device according to the invention is characterized in that the sleeves and the carriage form an integral unit. When the carriage is adjusted to the coupled position, the center line of the sleeves coincides with the center line of the cylindrical cavity so that the luminaire contacts mate with their respective sleeves. When the carriage is in the decoupled position, the sleeves occupy an asymmetrical position with respect to the center line of the cavity so that the luminaire contacts do not mate with their respective sleeves.

An advantage of this embodiment is that the luminaire cannot be secured on the housing of the device until the housing is locked on the rail. When the luminaire is secured in the housing, movement of the carriage is prevented, so that it is not possible to remove the housing with the secured luminaire from the rail. Thus, the safety of such a device is improved because it prevents the housing of the device from being removed from the rail together with a luminaire secured thereto while the luminaire is carrying current. In fact it has been found that in the known devices, situations in which the fire risk is high are liable to occur near the rail in such cases.

In another embodiment, the housing serves as a coupling member for two voltage rails arranged in line with each other. For this purpose, the carriage is provided, for example, with a first set of contact members which cooperate with current conductors in the first rail and with a second set of contact members which are electrically connected to the first set (for example by means of conductors in the housing or in the carriage) and cooperate with current conductors in the second rail. When voltage rails are coupled to three insulated current conductors, two sets of three contact members are consequently present on the carriage. In another embodiment, only one set of three elongate knife-shaped resilient contact members is present on the carriage. When placed on the rails to be coupled, the respective ends are secured to each other by adjusting the carriage to the coupled position, while at the same time the electrical connection between the current conductors is established.

An embodiment of the invention will now be described more fully by way of example with reference to the accompanying drawing.

DESCRIPTION OF THE PREFERRED EMBODIMENT

Figure 1:
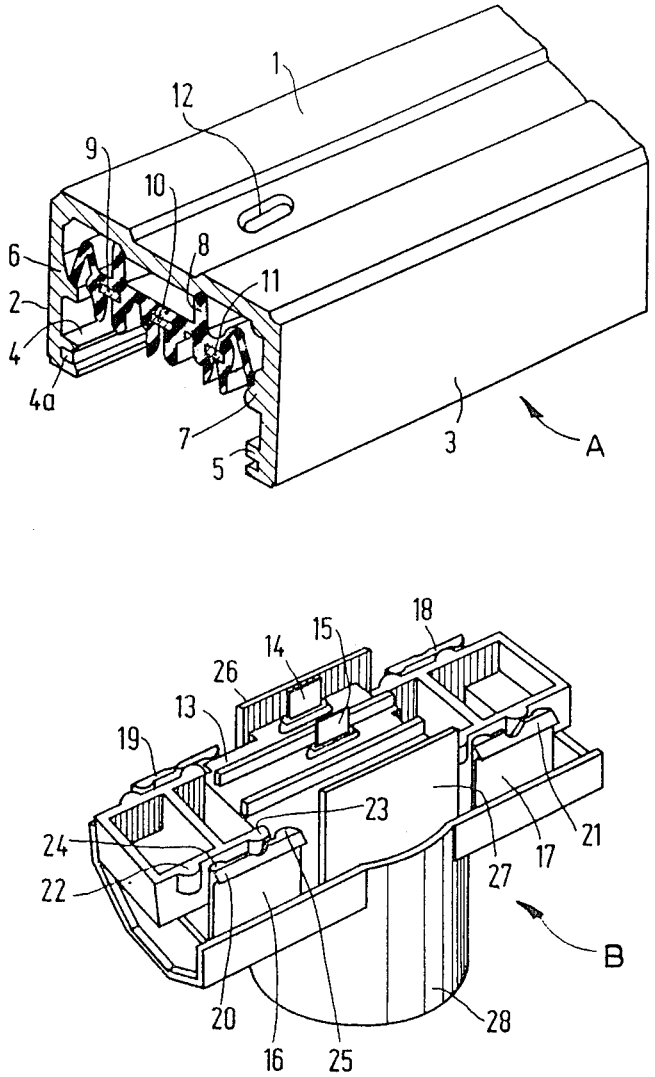
FIG. 1 is a perspective exploded view of a voltage rail and of a housing of a current collector device according to the invention, with the carriage in the decoupled position.

In FIG. 1, A denotes a voltage rail which has a channel-shaped aluminum wall. The rail comprises a bottom part 1 with two parallel side walls 2 and 3. Longitudinally extending ribs 4 and 5 are provided on the inner side of the side walls. In the proximity of the rib 4 a conductor 4*a*, is arranged for grounding the voltage rail. On the bottom part 1 a holder 8 of synthetic material is clamped between locking cams 6 and 7, respectively, provided on the side walls (2, 3). Three mutually insulated current conductors 9, 10 and 11 of copper are arranged at equal relative distances in the holder 8. The bottom part 1 is further provided with an opening 12 to secure the rail to a wall or a ceiling.

The letter B indicates a housing of electrically-insulative synthetic material of a current collector device according to the invention. The housing is shaped so that it can be pressed into the opening formed by the side walls 2 and 3 of the rail. The housing is provided on the side facing the rail with a carriage 13 which carries the blade shaped contact members 14 and 15. When the housing is pressed into the rail, an electrical connection is established between the current conductors (9, 10) and the contact members (14, 15). The contact members bear with a certain amount of resilient force on the current conductors.

Figure 3:
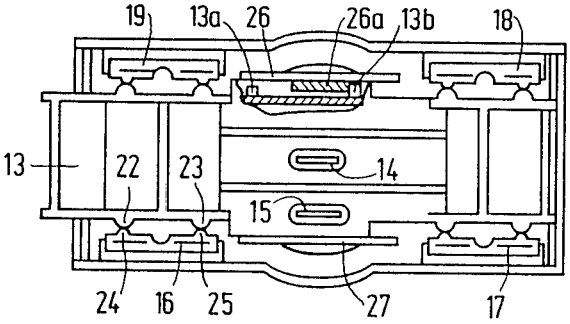
FIG. 3 is a top view of the housing.

The housing can be detachably secured in the rail by means of laterally projecting edges acting as latches present at its side cooperating with the ribs 4 and 5 present in the side wall of the rail. These edges are located on the outer side of four upright resilient tongues 16, 17, 18 and 19 located on either side of the carriage 13. By way of example, these edges on the tongues 16 and 17 are designated by reference numerals 20 and 21. The resilient tongues 16 to 19 also cooperate with cams such as cams 22 and 23 on the carriage 13 (see also FIG. 3). The carriage is slidable between two extreme positions, i.e. a decoupled position and a coupling position. When the carriage is adjusted to the decoupled position, the cams (22, 23) substantially do not touch the resilient tongues (such as 16). In FIG. 1, this position is shown. As soon as the housing is pressed on the rail, a user moves the carriage 13 into the coupling position, i.e. the carriage shown in the drawing is pressed to the right until the cams 22 and 23 on the carriage are located opposite to cams (such as 24 and 25) on the inner wall of a tongue (such as 16). The tongues are then pressed slightly outwards by the action of the opposing cams so that the edges (such as 20, 21) located on the outer side of the tongue are pressed behind the ribs 4 and 5 of the rail. The housing is then locked on the rail. The locked state is also visible in FIG. 4.

Figure 2:
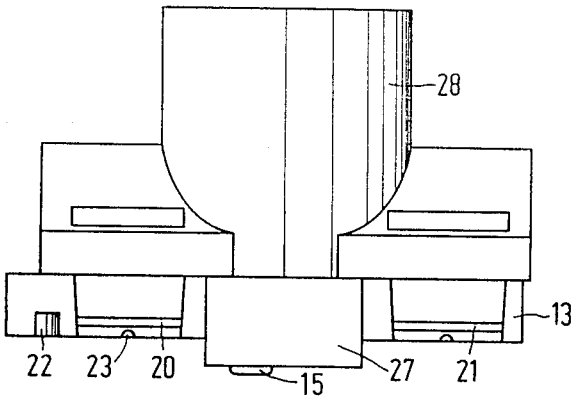
FIG. 2 is a side elevation of the housing of the current collector device.
Figure 4:
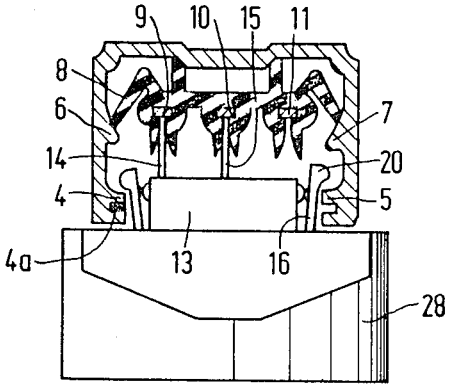
FIG. 4 shows a cross-section of the voltage rail and (diagrammatically) an elevation of the housing of the device, which is locked therein.

The housing is further provided with two upright walls 26 and 27 which are located on either side of the carriage 13 and cooperate on their inner side with the carriage, which due to ribs in these walls is substantially constrained from sideways movement (see FIGS. 2 and 3) while they cooperate on their outer side with the side walls of the rail when the housing is placed on the rail (for simplicity not shown in FIG. 4). The walls then accurately fit between the ribs 4 and 5. The walls 26 and 27 promote a good mechanical guidance when the housing is pressed into the rail. The carriage is slidable with respect to the housing between two extreme positions, the coupling position and the decoupled position. For this purpose, the carriage is provided on each side with an additional pair of cams (13*a* and 13*b*) which abut against a protuberance (such as 26*a*) on the inner side of the walls 26 and 27 (see FIG. 3).

Figure 5:
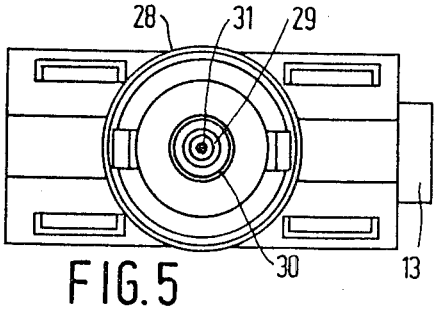
FIG. 5 is a plan view of the housing with the carriage in the coupled condition, FIG. 6 also is a plan view of the housing, but now with a carriage on the decoupled condition.
Figure 7:
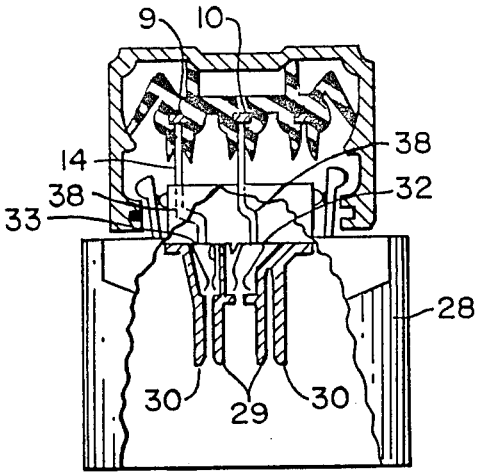
FIG. 7 is a side elevation of the housing broken away to reveal a sectional view of the sleeves and the second set of contacts with the carriage in the coupled position.
Figure 8:
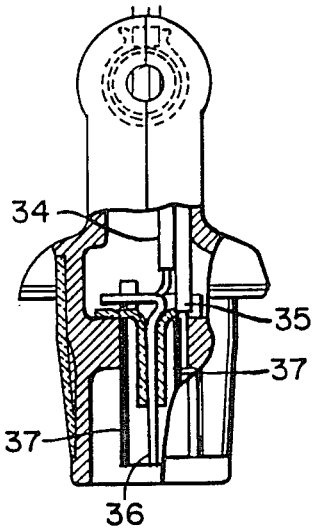
FIG. 8 is a side view of a luminaire tubular portion, partly broken away, for use with plug of the preferred embodiment.

On the side remote from the carriage, the housing is provided with a collar 28, which encloses a cylindrical cavity. The housing is then suitable to receive a tubular wall portion of a luminaire. Such a tubular wall portion is provided with a sheath of resilient material (such as metal), which is fixed on the wall portion of the luminaire. The sheath comprises a band having a number of resilient tongues which are radially directed towards the end of the wall portion and are located at a certain relative distance and whose ends are fixed on the outerside of the wall portion. Inside this sheath, the tubular wall portion, preferably consisting of synthetic material, is rotatable with a certain resistance through the full range of 360°. For a further description of such a luminaire, reference is made to the aforementioned U.S. Pat. No. 4,473,869 laid open to public inspection. In FIG. 8, the tubular wall portion is provided with current supply conductors 34, 35. The current supply conductor 34 is connected to contact pin 36 and the current supply conductor 35 is connected to contact cylinder 37. When placed in the cavity within collar 28 of the housing of the current collector device, the luminaire contacts 36, 37 cooperate with a second set of contacts located on the carriage. See FIGS. 7 and 9. These second contacts are electrically connected by means of slightly resilient conductors 38 to the respective blade-shaped contact members (14, 15) on the carriage 13. The current supply members are located on the lower side of two coaxially arranged sleeves 29, 30 (see FIGS. 5 and, 6 and 7) of electrically insulative synthetic material, which form an integral unit with the carriage and merge into the cavity within the collar 28. A first contact 32 is located on the lower side of the sleeve 29, while a second contact 33 is located on the lower side between the walls of the sleeves 29 and 30. These contacts then cannot be touched.

Figure 9:
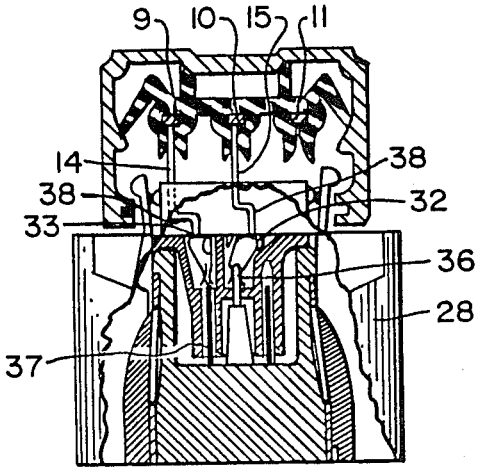
FIG. 9 is a side elevation of the housing broken away to reveal a sectional view of the luminaire contacts engaging the sleeves and second set of contacts on the carriage.

If the carriage is adjusted to the coupling position, (see FIG. 5) the center line 31 of the sleeves (29, 30) corresponds to the center line of the cylindrical cavity within the collar 28. The luminaire having the wall portion projecting in the form of a tube can then be inserted into the cavity 28, as shown in FIG. 9. The contact pin 36 engages contact 32 and the contact cylinder 37 engages contact 33 with the luminaire 13 is in the inserted position.

Figure 6:
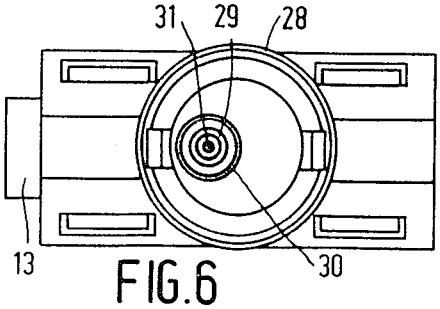

In FIG. 6, the carriage 13 is adjusted to the decoupled position; that is, the position in which the housing is not locked on the rail. The center line 31 of the sleeves then occupies an asymmetrical position with respect to the center line of the opening. The luminaire cannot then be secured on the housing by a user.

The housing comprises only a small number of components. It can therefore be readily assembled. The contact blades and the respective contacts 32, 33 located on the lower side of the sleeves each form an integral unit, the part of each unit located between the second contacts and the first contacts being folded at one point. Thus, a resilient action of the contact members is obtained when provided in the rail. The use of separate components (such as springs, clamps and the like) is then avoided.

What is claimed is:

1. A track connector plug for cooperation with a current-supply track having facing side walls extending in a longitudinal direction, ribs on respective inner sides of said side walls extending in said longitudinal direction, and mutually insulated current conductors extending longitudinally between said side walls, said connector plug comprising:

(a) a molded housing of synthetic material comprising resilient tongues integrally molded with said housing and arranged on opposite sides of said housing, each tongue having a respective cam and a free end, said tongues being spaced to allow insertion of said plug into said track and displacement of each free end against a respective track rib for engaging said track ribs and holding said housing within the track, said housing having means for securing a luminaire; and (b) a carriage mounted on said housing so as to be slidable in the longitudinal direction when said plug is in the inserted position between a decoupled and a coupled position, said carriage comprising a first set of contacts each spaced to contact a respective track current-supply conductor, means for biasing said first contacts against said track current supply conductors, means for connecting said first contacts to contacts of a luminaire received in said housing, and a plurality of cams each arranged to cooperate with a respective tongue cam;

when the carriage is in the decoupled position said cooperating cams leaving said free ends in an unbiased position to allow insertion of said plug into said track and removal of said plug from said track, when the carriage is in the coupled position said cooperating cams urging said free ends against a corresponding track rib, each free end having a surface which cooperates with a corresponding rib to lock said plug into said track, sliding of said carriage between the coupled and decoupled positions causing a scraping action between each biased first contact and its respective current-supply conductor.

2. A track connector plug as claimed in claim 1, wherein said first set of contacts comprises a blade-shaped contact corresponding to each current-supply conductor.

3. A track connector plug as claimed in claim 1, wherein said luminaire securing means comprises a collar extending away from said carriage, said collar having an inner wall surface enclosing a cavity shaped to receive a luminaire, and said connector means comprises a second set of contacts each connected to a respective first contact, said second contacts being arranged on said carriage to contact corresponding contacts on a luminaire received in said cavity when said carriage is in said coupled position, said second contacts being positioned not to contact said luminaire contacts when said carriage is in said decoupled position.

4. A track connector plug as claimed in claim 3, wherein said carriage further comprises inner and outer coaxial sleeves of synthetic material integrally molded with said carriage extending in the same direction as said collar, in the coupled position said sleeves being coaxial with said collar, in the decoupled position said sleeves being eccentric with respect to said collar, one of said second contacts being located between the walls of the inner sleeve and another of said second contacts being located between the walls of said inner and outer sleeves.

5. A track connector plug as claimed in claim 1, wherein said housing further comprises two parallel walls extending in said longitudinal direction disposed on respective sides of said carriage, said parallel walls having inner sides which guide said carriage between the decoupled and coupled positions and outer sides which cooperate with the sidewalls of said track to guide said plug when said plug is inserted in said track.

6. A track connector plug as claimed in claim 5, wherein said luminaire securing means comprises a collar extending away from said carriage, said collar having an inner wall surface enclosing a cavity shaped to receive a luminaire, and said connector means comprises a second set of contacts each connected to a respective first contact, said second contacts being arranged on said carriage to contact corresponding contacts on a luminaire received in said cavity when said carriage is in said coupled position, said second contacts being positioned not to contact said luminaire contacts when said carriage is in said decoupled position.

7. A track connector plug as claimed in claim 6, wherein said carriage further comprises inner and outer coaxial sleeves of synthetic material integrally molded with said carriage extending in the same direction as said collar, in the coupled position said sleeves being coaxial with said collar, in the decoupled position said sleeves being eccentric with respect to said collar, one of said second contacts being located between the walls of the inner sleeve and another of said second contacts being located between the walls of said inner and outer sleeves.

8. A track connector plug as claimed in claim 7, wherein said housing comprises said parallel walls arranged between two pairs of opposing tongues.

9. A track connector plug as claimed in claim 8, wherein said first set of contacts comprises a blade-shaped contact corresponding to each current-supply conductor.

10. A track lighting system, comprising (a) a current-supply track having facing side walls extending in a longitudinal direction, ribs on respective inner sides of said side walls extending in said longitudinal direction, and mutually insulated current-supply conductors extending longitudinally between said side walls;

(b) a molded housing of synthetic material comprising resilient tongues integrally molded with said housing and arranged on opposite sides of said housing, each tongue having a respective cam and a free end, said tongues being spaced to allow insertion of said housing into said track and displacement of each free end against a respective track rib for engaging said track rib and holding said housing within the track, said housing having means for securing a luminaire; and (c) a carriage mounted on said housing so as to be slidable in the longitudinal direction when said housing is in the inserted position between a decoupled and a coupled position, said carriage comprising a first set of contacts each spaced to contact a respective track current-supply conductor, means for biasing each first contact against said track current supply conductor, means for connecting said first contacts to contacts of a luminaire received in said housing, and a plurality of cams each arranged to cooperate with a respective tongue cam;

when the carriage is in the decoupled position said cooperating cams leaving said free ends in an unbiased position to allow insertion and removal of said housing into said track, when the carriage is in the coupled position said cooperating cams urging said free ends against a corresponding track rib, each free end having a surface which cooperates with a corresponding rib to lock said housing into said track, sliding of said carriage between the coupled and decoupled positions causing a scraping action between each biased first contact and its respective current-supply conductor.

11. A track lighting system as claimed in claim 10, wherein said first set of contacts comprises an elongated knife shaped contact corresponding to each current-supply conductor.

12. A track lighting system as claimed in claim 10, wherein said housing further comprises two parallel walls extending in said longitudinal direction disposed on respective sides of said carriage, said parallel walls having inner sides which guide said carriage between the decoupled and coupled positions and outer sides which cooperate the sidewalls of said track to guide said housing when said housing is inserted in said track.

13. A track lighting system as claimed in claim 12, wherein said luminaire securing means comprises a collar extending away from said carriage, said collar having an inner wall surface enclosing a cavity shaped to receive a luminaire, and said connector means comprises a second set of contacts each connected to a respective first contact, said second connectors being arranged on said carriage to contact corresponding contacts on a luminaire received in said cavity when said carriage is in said coupled position, said second contacts being positioned not to contact said luminaire contacts when said carriage is in said decoupled position.

14. A track lighting system as claimed in claim 10, wherein said luminaire securing means comprises a collar extending away from said carriage, said collar having an inner wall surface enclosing a cavity shaped to receive a luminaire, and said connector means comprises a second set of contacts each connected to a respective first contact, said second connectors being arranged on said carriage to contact corresponding contacts on a luminaire received in said cavity when said carriage is in said coupled position, said second contacts being positioned not to contact said luminaire contacts when said carriage is in said decoupled position.

15. A track lighting system as claimed in claim 14, wherein said carriage further comprises inner and outer coaxial sleeves of synthetic material integrally molded with said carriage extending in the same direction as said collar, in the coupled position said sleeves being coaxial with said collar, in the decoupled position said sleeves being eccentric with respect to said collar, one of said second contacts being located between the walls of the inner sleeve and the other of said second contacts being located between the walls of said inner and outer sleeves.

16. A track lighting system as claimed in claim 15, wherein said housing comprises said parallel walls arranged between two pairs of opposing tongues.

* * * * *